US008004545B2

(12) United States Patent
Inuzuka et al.

(10) Patent No.: US 8,004,545 B2
(45) Date of Patent: Aug. 23, 2011

(54) DISPLAY APPARATUS WITH ARRANGEMENT TO DECREASE QUANTITY OF BACKLIGHT AND INCREASE TRANSMITTANCE OF THE DISPLAY PANEL

(75) Inventors: Tatsuki Inuzuka, Mito (JP); Shinichi Komura, Mobara (JP); Yoshifumi Sekiguchi, Hitachiota (JP)

(73) Assignee: Hitachi Displays, Ltd., Chiba (JP)

( * ) Notice: Subject to any disclaimer, the term of this patent is extended or adjusted under 35 U.S.C. 154(b) by 944 days.

(21) Appl. No.: 11/869,765

(22) Filed: Oct. 10, 2007

(65) Prior Publication Data

US 2008/0084524 A1 Apr. 10, 2008

(30) Foreign Application Priority Data

Oct. 10, 2006 (JP) ..... 2006-275966

(51) Int. Cl.
*G09G 5/10* (2006.01)
*G09G 3/36* (2006.01)

(52) U.S. Cl. ..... 345/690; 345/102; 345/87

(58) Field of Classification Search ..... 345/690, 345/102

See application file for complete search history.

(56) References Cited

U.S. PATENT DOCUMENTS

2002/0193081 A1* 12/2002 Kato ..... 455/90
2004/0113875 A1* 6/2004 Miller et al. ..... 345/82
2004/0178973 A1* 9/2004 Miller et al. ..... 345/82
2005/0225562 A1 10/2005 Higgins et al.
2006/0256054 A1* 11/2006 Baek ..... 345/88
2007/0146252 A1* 6/2007 Miller et al. ..... 345/77

FOREIGN PATENT DOCUMENTS

| | | |
|---|---|---|
| CN | 1731500 A | 2/2006 |
| JP | 60-283672 | 12/1985 |
| JP | 2006-106294 | 4/2006 |
| JP | 2006-317898 | 11/2006 |

OTHER PUBLICATIONS

Chromatic Science Handbook, Second edition, edited by Chromatic Academic Society of Japan, published by Tokyo University Publication, 1998.

* cited by examiner

*Primary Examiner* — Richard Hjerpe
*Assistant Examiner* — Andrew Schnirel
(74) *Attorney, Agent, or Firm* — Antonelli, Terry, Stout & Kraus, LLP.

(57) ABSTRACT

A display apparatus is arranged to have pixels, each of which has a RGBW (Red, Green, Blue and White) wavelength distribution characteristic, located two-dimensionally. The display apparatus includes an input unit for inputting a signal for controlling a using ratio of a W signal, a color signal converting unit for calculating a RGBW driving signal from a RGB input signal and the W using ratio. The RGBW signal is calculated so as to control the contribution of the W signal to the image quality. The display apparatus switches the display from the contrast-highlighted display in a relatively bright lighting condition to the color-reproducibility-highlighted display in a relatively gloomy lighting condition.

10 Claims, 9 Drawing Sheets

DISPLAY APPARATUS WITH ARRANGEMENT TO DECREASE QUANTITY OF BACKLIGHT AND INCREASE TRANSMITTANCE OF THE DISPLAY PANEL

BACKGROUND OF THE INVENTION

1. Field of the Invention

The present invention relates to a display apparatus which provides a capability of displaying a color image.

2. Description of the Related Art

As a color image display apparatus, a liquid crystal display has been proposed which includes a liquid crystal panel served to control a light transmittance of each pixel and a backlight unit combined therewith so that a color image may be displayed.

To display a color image, it is necessary to include at least three primary color components of RGB (Red, Green and Blue) in the backlight and locate sub-pixels each of which has one of at least RGB color filters as the pixels composing the liquid crystal panel. This arrangement makes it possible to control a light quantity on the overall range of a wavelength. Herein, the sub-pixel provides any one of RGB color filters and corresponds to a minimum unit of transmittance control. The pixel, termed herein, designates a combination of three sub-pixels of the RGB. Lots of pixels are ranged on the screen plane of the display apparatus. The other display apparatuses of a CRT (Cathode-ray Tube) system, a plasma system, a projector system and so forth have the same fundamental principle of display as that of the liquid crystal display apparatus, that is, those apparatuses also display a color image by properly arranging the pixels.

In the meantime, illumination brightness is considered as an environmental condition of a place where the display apparatus is located. An observer of a display screen watches an image in the synthesized light of ambient light reflected on the display screen and the light displayed by the display apparatus itself.

Letting a contrast R be a ratio of a maximum to a minimum of brightness of a display screen, the relation between the display light and the reflected light is represented as follows:

$$R=(\text{Maximum Display Light Quantity}+\text{Reflected Light Quantity})/(\text{Minimum Display Light Quantity}+\text{Reflected Light Quantity})$$

In general, as the contrast R becomes greater, a visibility is made better. Herein, the maximum display light quantity designates a display light quantity corresponding with a maximum value of a display signal and the minimum display light quantity designates a display light quantity corresponding with a minimum value of a display signal. To improve the contrast, it is effective to make the maximum display light quantity greater or the reflected light quantity smaller.

To manage the contrast of the display screen, a method has been known in which a light sensor for sensing a brightness of ambient light is prepared so that an intensity (luminance) of the display light may be variably set according to the output of the light sensor.

The JP-A-2006-106294 discloses a technique of varying a luminous quantity of the backlight unit depending upon the ambient light, for example, in a gloomy room or a bright outdoor place. Concretely, during daylight, the technique is caused to increase the maximum display light quantity of the display screen by raising the luminous quantity of the backlight unit based on the output signal of the light sensor. This technique makes the contrast R higher and thereby the visibility better.

The US 2005/0225562 proposes a technique of adding a sub-pixel of W (White) to a combination of three RGB sub-pixels of RGB in order to improve the luminance of the display panel itself. The W sub-pixel provides no color filter, so that it has a high light transmittance and thus is effective in improving the luminance. Concretely, when the conventional pixels each composed of the RGB sub-pixels are compared with the pixels each composed of the RGBW sub-pixels on the same area, the area ratio of the sub-pixels of the former to the latter is made to be 4:3. The RGB color filters cut a wavelength distribution of a light source into one third, while the W color filter transmits a light quantity of a light source as it is. In light of this relation, the ratio of the maximum display light quantity of the RGB panel to the RGBW panel is made to be ((4+4+4)/3):((3+3;3)/3+3×1)=1:1.5

As a method of generating a RGBW signal to be used for driving the RGBW pixels, the following process has been proposed. The minimum values of the input color signals of the RGB are set to a W=MIN (R, G, B) signal or the values derived by subtracting W from the RGB color signals are newly set to a R' G' B'(R'=R−W, G'=G−W, B'=B−W) signal. By multiplying a proper amplification factor by the W signal, it is effective to improve the luminance.

Further, the technical background of the color reproducibility is discussed in detail in "Chromatic Science Handbook, Second edition, edited by Chromatic Academic Society of Japan, published by Tokyo University Publication, 1998".

SUMMARY OF THE INVENTION

In general, to define a color of a dot on a color gamut, the display apparatus is arranged to fix chromaticities of the three primary colors of RGB on which the additive color mixture is carried out and to specify a mixture ratio of the three primary colors based on the RGB signals. As to the RGBW panel in which the W sub-pixel is added to each combination of the RGB sub-pixels, however, the W sub-pixel serves to improve the luminance, while it brings about a phenomenon that the chromaticities of the three primary colors are varied (the color gamut is changed).

This phenomenon is brought about on the ground that the luminous wavelength distribution of the W sub-pixel is overlapped with the luminous wavelength distributions of the three primary colors of RGB, that is, the W wavelength distribution depending upon the light quantity of the W sub-pixel is overlapped with each of the three primary colors. This varies the chromaticities of the three primary colors. This variation becomes an obstacle to executing the additive color mixture. Concretely, if the luminous quantity of the W sub-pixel is zero, the color gamut becomes maximum, while the luminous quantity of the W sub-pixel is MAX, the color gamut becomes minimum. As such, as the using ratio of the W sub-pixel is made higher for the purpose of improving the luminance, the color gamut is made smaller and thus the display screen becomes whitish.

As described above, in the RGBW panel, the luminance improvement characteristic conflicts with the color reproducible characteristic depending upon the using ratio of the W sub-pixel. The W sub-pixel is not included in the conventional RGB panel and thus the signal corresponding to the using ratio of the W sub-pixel is not supplied to the conventional RGB panel as well.

The foregoing prior art discloses the luminance improving principle by adding the W sub-pixel but does not suggest a color signal conversion to be executed in consideration of the color reproducible characteristic depending upon the luminous quantity of the W sub-pixel. Concretely, the foregoing prior art does not mention the using ratio of the W sub-pixel. Accordingly, it means that the display screen of the prior art is made whitish.

$$\begin{bmatrix} Rout \\ Gout \\ Bout \\ Wout \end{bmatrix} = C \cdot \begin{bmatrix} Rin \\ Gin \\ Bin \end{bmatrix} \quad \text{[Expression 1]}$$

In other words, the color signal conversion method of converting the RGB input signals to the RGBW output signals corresponds to obtention of a conversion matrix C to be used for relating the three inputs with the four outputs by an equal sign. Herein, if the W depends upon the RGB signal in a manner that the minimum values of the input color signals of the RGB three colors are set as a W=MIN(R, G, B) signal, the contribution of the W signal to the image quality cannot be controlled. That is, the condition of controlling the RGBW of the output signals is not met, so that a solution (conversion matrix C) cannot be obtained.

It is an object of the present invention to provide a display apparatus provided with the operating method of calculating the four color signals of the RGBW so that the input signals of the RGB and the contribution of the W signal to the image quality may be controlled, for the purpose of improving the luminance of the liquid crystal panel composed of the RGBW sub-pixels.

In carrying out the foregoing object, according to an aspect of the invention, the display apparatus includes signal input means and color signal converting means for calculating RGBW signals from RGB input signals and a using ratio of a W signal, for the purpose of controlling the using ratio of the W signal.

To convert the color signal, a brightness of ambient light, for example, is inputted as a signal to be used for controlling the using ratio of the W signal from a sensor and the using ratio of the W sub-pixel is changed on the display screen. This operation results in realizing the color signal conversion so that the resulting image quality may meet the quality required by an observer in any kind of watching environment.

Further, the display apparatus according to the invention provides signal processing means based on the following phenomenon. In general, the phenomenon that two colors having respective spectral compositions are viewed as the same color is called metamerism. This phenomenon is brought about because a human's visual sense has a wavelength distribution characteristic called the RGB (Red, Green and Blue) but cannot decompose all wavelength distributions. In the present invention, following the foregoing phenomenon of the human's visual sense, the phenomenon that the colors outputted by the different combinations of RGBW are viewed as the same color is called the metamerism. This phenomenon is brought about because the wavelength distribution of the W is overlapped with the wavelength distributions of the RGB. As a simple example, two different color signals of (R=G=B=constant, W=0) and (R=G=B=0, W=constant) appear as the same color. Further, in consideration of the various combinations of the signals halfway between them, lots of combinations of the color signals are viewed as the same colors. The display apparatus according to the present invention provides means for modifying the combination of the RGBW as keeping the display color by using the phenomenon of the display apparatus corresponding to the foregoing metamerism. Herein, the present invention considers the influence of the luminous wavelength of the backlight. The display apparatus according to the invention provides means for determining a combination of the driving signals for outputting the same color based on the foregoing metamerism of the display apparatus.

The human's visual characteristic has a capability of visually perceiving three primary colors of the RGB differently. However, when an observer watches an object though he or she does not adapt his or her eyes to a quite bright environment, the observer senses the object is whitish because the three visual perceptions of the RGB are saturated. The gradual adaptation of his or her eyes to the current environment dissolves the saturated perceptions, so that the observer can correctly perceive the ratio of the RGB and thus adapt his or her visual sense to a color reproducing characteristic.

Hence, to enhance the visibility in the bright environment like an outdoor place, the contrast (improved luminance) is more important than the color reproducible characteristic. On the other hand, in a relatively gloomy environment, the three RGB colors can be relatively correctly perceived. Hence, the color reproducible characteristic is more important. As described above, the portable display apparatus to be used in an observing environment with the ambient light being widely varied is required to have the image quality corresponding with the environment.

The display apparatus according to the embodiment of the present invention realizes the effect of meeting the image qualities required in various observing environments by continuously switching the luminance improvement to the color reproducing characteristic or vice versa, both of which are conflicting with each other and depend upon the using ratio of the W sub-pixel, with the environmental brightness as a parameter.

The display apparatus according to the embodiment of the present invention provides a capability of outputting an image display with the contrast intensified in a relatively bright illuminating environment but with the color reproducibility intensified in a relatively gloomy illuminating environment by variably setting the using ratio of the W pixel according to the brightness of the lighting condition around the display apparatus itself. This capability leads to realization of a high visual recognizing characteristic in a wide range of illuminating environment.

The human's visual characteristic has a capability of visually perceiving the three colors of the RGB differently. However, when an observer watches an object though his or her eyes are not sufficiently adapted to a quite bright environment, the visual senses of the RGB are saturated, so that the observer may senses the object is whitish. The gradual adaptation of his or her eyes to the environment makes it possible for the observer to correctly perceive the ratio of the RGB colors by his or her eyes and thereby adapt his or her visual sense to the color reproducible characteristic.

To enhance the visibility in a bright environment like an outdoor place, therefore, the contrast (improvement of luminance) is more important than the color reproducible characteristic. On the other hand, in a relatively gloomy environment, since the visual senses of the three colors of the RGB are sufficiently effective, the color reproducible characteristic is more important. As such, the portable display apparatus that is ordinarily used in the widely varied lighting condition is required to meet the image quality corresponding with the lighting condition around the portable display apparatus itself.

The display apparatus according to the present invention is effective in meting the image qualities required by the various lighting conditions around the display apparatus by continuously switching the improved luminance and the color reproducing characteristic, both of which are conflicting with each other and depend upon the using ratio of the W sub-pixel, with the environmental brightness as a parameter.

The human's visual sense has a capability of visually perceiving the three colors of the RGB differently. However, if an observer watches an object when the adaptation of his or her eyes are not sufficiently adapted to a quite bright environment, since the visual senses of the three colors of the RGB are saturated, the observer senses that the object is whitish. The gradual adaptation of his or her eyes to the environment dissolves the saturated visual senses, so that the observer can correctly perceive the ratio of the RGB and thus adapt his or her visual sense to a color reproducing characteristic.

To enhance the visibility in a bright lighting condition like an outdoor place, therefore, the contrast (improvement of luminance) is more important than the color reproducible characteristic. On the other hand, in a relatively gloomy environment, since the visual senses of the three colors of the RGB are sufficiently effective, the color reproducible characteristic is more important. As such, the portable display apparatus that is ordinarily used in the widely varied lighting condition is required to meet the image quality corresponding with the lighting condition around the portable display apparatus itself.

The display apparatus according to the present invention is effective in meting the image qualities required by the various lighting condition around the display apparatus by continuously switching the improvement of luminance and the color reproducing characteristic or vice versa, both of which are conflicting with each other and depend upon the using ratio of the W sub-pixel, with the environmental brightness as a parameter.

The display apparatus according to the present invention includes means for modifying the RGBW signals by using the metamerism of the display apparatus itself. The modifying means serves to modify the RGBW signals so that the backlight quantity required for displaying an image may be reduced. This modification is effective in reducing the driving electric power of the display apparatus as keeping the colors on the display screen.

The present invention may apply to a liquid crystal display apparatus or a TV set, a personal computer, a monitor, and so forth to which the liquid crystal display apparatus may be applied.

Other objects, features and advantages of the invention will become apparent from the following description of the embodiments of the invention taken in conjunction with the accompanying drawings.

DETAILED DESCRIPTION OF THE EMBODIMENTS

Hereafter, the embodiments of the present invention will be described with reference to the appended drawings.

Embodiments

(1) Relational Expression of Four Inputs and Four Outputs

Figure 1:
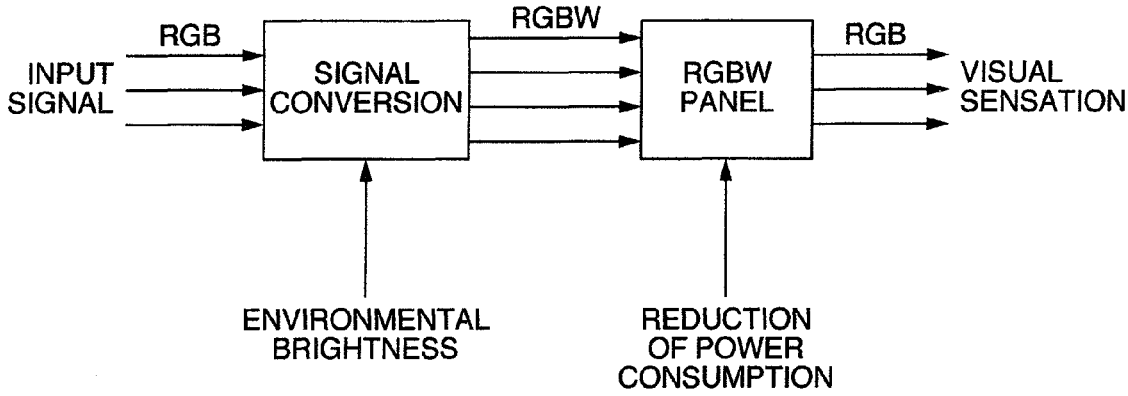
FIG. 1 is a block diagram showing a basic arrangement of the present invention.

FIG. 1 shows a basic arrangement of an apparatus to which the present invention is applied. This is an arrangement of converting an input RGB signal into a RGBW signal to be used for displaying an image. Herein on later, the RGB signal used or to be used in the singular form is a term that collectively represents the R, the G and B signals. So is the RGBW signal. The present invention does not depend upon the panel structure on which the RGBW signal is to be represented. For example, a panel structure composed of liquid crystal elements and filters provided with the wavelength transmitting characteristic of the RGBW signal may be used for this purpose. Further, the present invention does not depend upon the arrangement of the driving circuit to be used therefore. Moreover, in the following description, a gamma characteristic of an I/O signal is left out.

$$\begin{bmatrix} Rout \\ Gout \\ Bout \\ Wout \end{bmatrix} = C \cdot \begin{bmatrix} Rin \\ Gin \\ Bin \\ Xin \end{bmatrix} \quad \text{[Expression 2]}$$

The embodiment of the present invention is characterized in that an input means is prepared for a new signal X as indicated in the expression 2 in order to convert the relation of three inputs and four outputs indicated in the expression 1 into the relation of four inputs and four outputs from which a unique solution can be obtained. The input means for a new signal is provided with the function of reading a brightness of a lighting condition around the display apparatus, a taste of a user, a characteristic of a signal to be represented, and so forth as the corresponding numeric values. Those parameters may be used uniquely or as a group. Further, means for converting the numeric value of the input signal into a proper numeric value to be used inside may be also used with the input means. Moreover, the conversion matrix C indicated in the expression 2 is not necessarily the linear coupling relation. It may be any coupling relation of a function, a conversion table, and so forth. The foregoing mechanism makes it possible to actively control the using ratio of the W sub-pixel.

Further, according to the embodiment of the present invention, the relation between the RGBW signal generated for displaying an image and the three primary colors visually sensed by human's eyes is grasped as a system of four inputs and three outputs. Moreover, if the embodiment of the present invention is applied to the liquid crystal display apparatus, the combination of the RGBW liquid crystal panel and the driving signal of the backlight unit is grasped as a system of N inputs and three outputs. The present invention thus has a capability of, for example, calculating the driving signal for reducing the power consumption by using the degree of freedom on the input side appearing in the relation expression.

Figure 2:
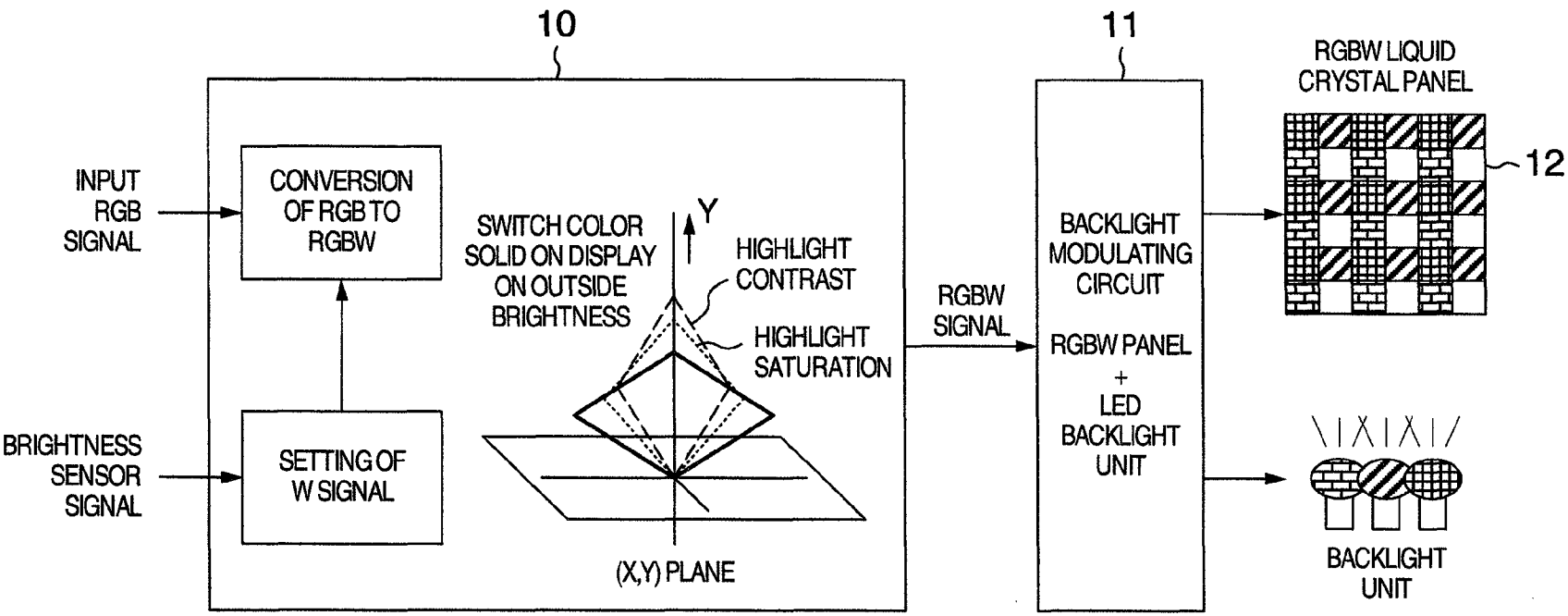
FIG. 2 is a diagram showing an exemplary arrangement of a device to which a brightness of an environment around a display apparatus according to the present invention is to be inputted.

(2) Method of Using Brightness of Lighting Condition Around the Display Apparatus as New Condition FIG. 2 shows an exemplary arrangement according to an embodiment of the present invention. This is arranged to set a brightness of the lighting condition around the display apparatus to the using ratio of the W signal. This arrangement includes as basic components a color signal converting unit 10 that is supplied with a brightness sensing signal representing the brightness of the lighting condition and a three-color (RGB) signal and converts those signals into a four-color (RGBW) signal, a backlight modulating circuit 11 for controlling a liquid crystal element transmittance and a backlight quantity, and a panel 12 on which the RGBW sub-pixels are located two-dimensionally.

In the color signal conversion from the input RGB signal to the output RGBW signal, the relation is replaced with the relation of four inputs and four outputs by adding the using ratio of the W sub-pixel as a condition so that a unique solution may be obtained from the four-input and four-output relation. The using ratio of the W sub-pixel is effective in changing the luminance improving characteristic and the color reproducing characteristic on the display. In other words, it is effective in changing the form of a color solid on the display. To describe the effect, at first, the description will be oriented to the color solid.

(3) Description About Color Solid and Transformation Thereof Caused by W

Figure 3:
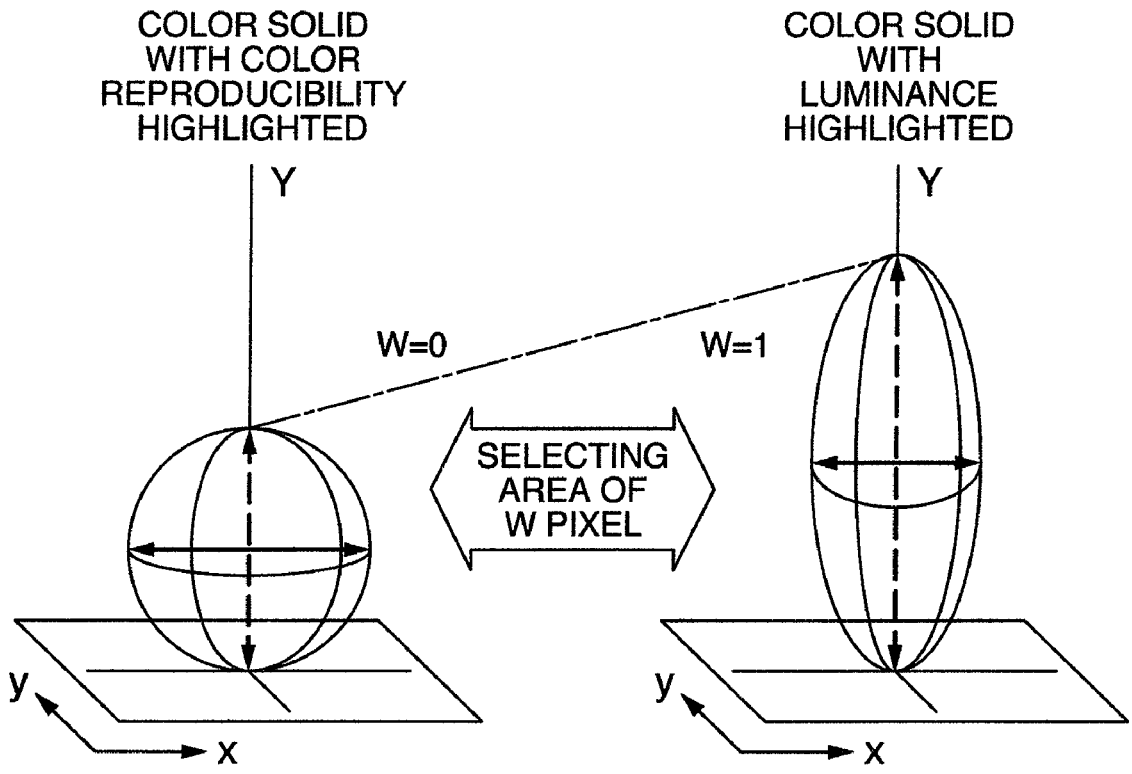
FIG. 3 is a view showing relation between a using ratio of a W sub-pixel and a display color solid.

FIG. 3 diagrammatically shows the relation between the using ratio of the W sub-pixel and the color solid. The simple method for improving the luminance components of the RGB signal is addition of the W signal. However, since the W signal includes all wavelengths, the color saturation is made lower. As such, the luminance improving effect is generally conflicting with the color reproducing characteristic. If the W signal is calculated as a function depending on the RGB like W=F (R, G, B) (where F is any function), the relation between the luminance and the color saturation, the relation being defined by the using ratio of the W signal, cannot be controlled.

The display apparatus according to the embodiment of the invention is characterized in that means is provided for actively determining the foregoing conflicting relation between the luminance improving effect and the color reproducing characteristic. For example, the output signal of a brightness sensor for sensing a brightness of the lighting condition around the display apparatus is used for that purpose. In a bright lighting condition, the luminance improving effect is more important, while in a gloomy lighting condition, the color reproducing characteristic is more important. In the brightness of the lighting condition halfway between them, the image quality is continuously changed depending upon the brightness of the lighting condition. As a concrete adjusting item for continuously changing the image quality, the using ratio of the W sub-pixel is controlled.

The form of the color solid to be represented on the display panel is continuously changed depending upon the using ratio of the W sub-pixel. It goes without saying that the chromaticities of the primary colors of the RGB are changed depending upon the using ratio of the W sub-pixel. The additive color mixture is not executed if the primary colors of the RGB are changed. However, since the using ratio of the W sub-pixel is common to each of the RGB sub-pixels, in the condition that the using ratio of the W sub-pixel is fixed, the additive color mixture of the RGB primary colors is allowed to be executed. Hence, the display apparatus according to the embodiment of the invention operates to set the using ratio of the W sub-pixel according to the brightness of the lighting condition, drive the RGB sub-pixels in response to the RGB input signal in the condition of the fixed using ratio, and display the colors supplied by the additive color mixture. The combination of the pixels ranged on the overall display screen thus forms a color image on the screen.

Figure 4:
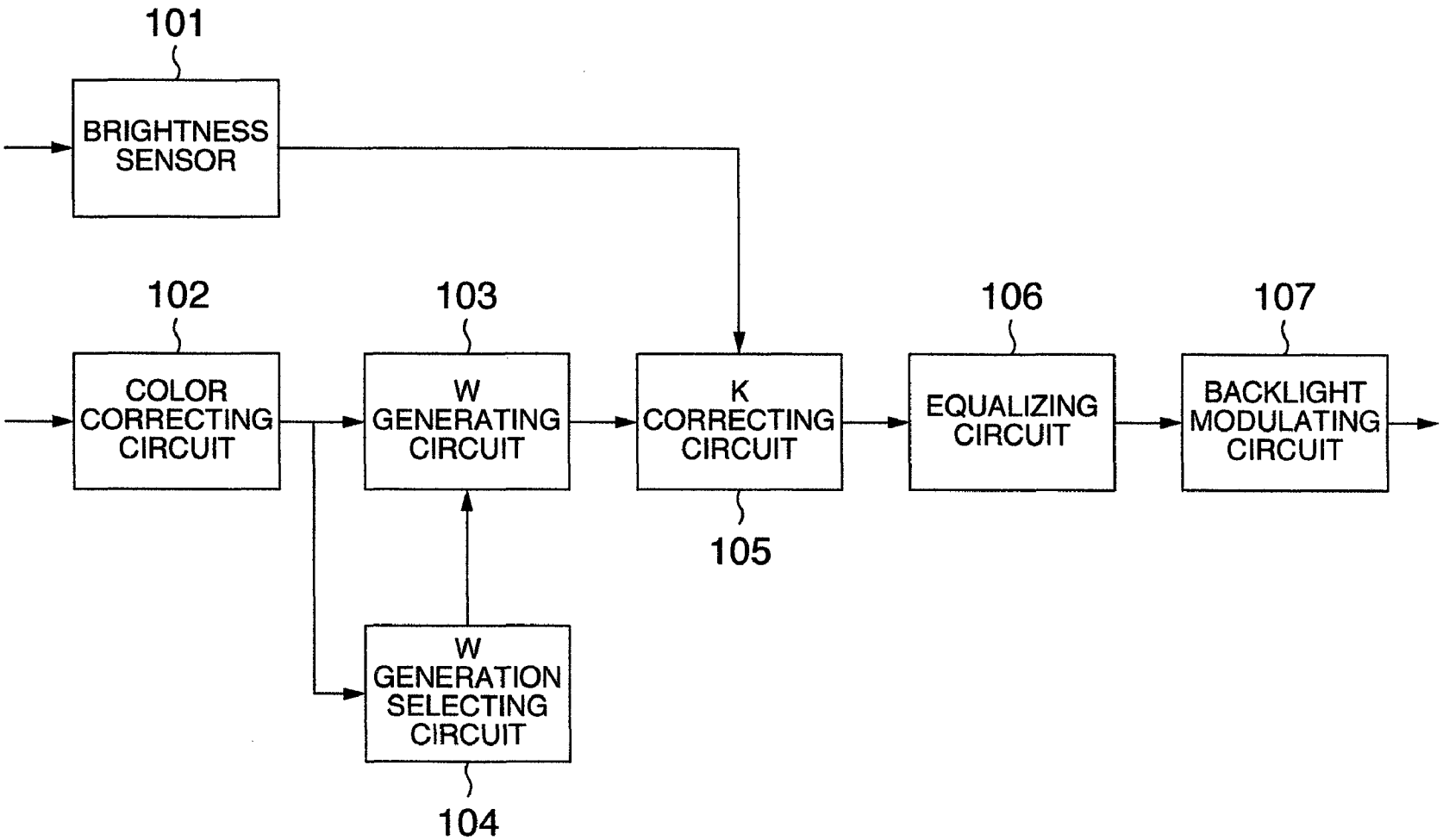
FIG. 4 is a block diagram showing an exemplary arrangement of a signal processing circuit included in an embodiment of the present invention.

(4) Exemplary Arrangement of Signal Processing Circuit Included in the Embodiment FIG. 4 shows an arrangement of a signal processing circuit included in the display apparatus according to an embodiment of the invention.

The signal processing circuit is arranged to have a brightness sensor 101 for sensing a brightness of a lighting condition around the display apparatus, a color correcting circuit 102 for color-correcting a RGB signal to be inputted therein, a W generating circuit 103 for selectively executing one of the methods for calculating the W signal, a W generation selecting circuit 104 for selecting the methods for calculating the W signals, a K correcting circuit 105 for adjusting the W signal with an output signal of the brightness sensor as a correction coefficient K, an equalizing circuit 106 for equalizing the signal as keeping the color and the luminance of the RGBW signal generated at the previous stage, and a backlight modulating circuit 107 for calculating a liquid crystal panel driving signal and a backlight unit driving signal from the RGBW signal outputted from the equalizing circuit 106.

Hereafter, the description will be oriented to the operation and the arrangement of each of the foregoing circuits. Since there are many coordinate systems that represent a color signal, plural kinds of signal components are provided about the luminance and the color gamut. For example, 1) In the RGB space, a common component W to each RGB signal and a color saturation component derived by subducting W from each RGB signal, 2) In the HSL space, a brightness component L and a component S that designates color vividness, and 3) In the xyY space, a luminance Y and a chromaticity xy wherein the RGB space is a space created by the properly defined RGB signal, the HSL space is a space created by H (hue), S (Saturation), and L (lightness), and the xyY space is a space created by a chromaticity xy and Y (luminance).

As another space, the XYZ space or the Lab space may be referred, which space is created in consideration of the human's visual characteristic. The present invention is not intended for specifying one of many signal types as described above. The signal components of the luminance (brightness and lightness) and the color reproducing characteristic (color saturation and color gamut) are used in the present invention.

The luminance and the color reproducing characteristic of the display screen are managed depending upon the brightness of the lighting condition. To make the description simple, in the following embodiment, the signal component about the luminance is denoted by W. Instead of W, L (Lightness) and Y (Luminance) may be used therefor. Further, it goes without saying that those elements may be mixedly used in the signal processing by preparing means for converting these elements.

(5) Sensor 101

The display apparatus according to the embodiment of the invention has a capability of calculating a correction coefficient K for defining the using ratio of the W sub-pixel on the basis of the brightness of the lighting condition around the display apparatus. The brightness sensor to be used for this purpose is a photo sensor manufactured by silicon, CDS (cadmium sulfide) or the like. The output signal from the sensor is analog-to-digital converted into the digital signal and is read. The prepared conversion table is read by using the digital values. This conversion table is used for defining the using ratio K of the W. The function of calculating the correction coefficient K may be prepared as another circuit. As such, the embodiment of the present invention is characterized in that the signal to be represented as an image is actively controlled depending upon the brightness of the lighting condition in order to enhance the image quality on the display screen visually perceived by an observer. In addition, the factor to be used for defining the using ratio K is not limited to the brightness. To describe the merit as the display apparatus, herein, the brightness is exemplarily used. This brightness sensor may be replaced with a switch to be specified by a user.

(6) Color Correcting Circuit 102

The color correction included in the present invention will be described herein. Basically, the correction for image quality may be carried out with respect to the RGB signal or any three-color signal converted therefrom. This process may be located at a stage previous to the generation of the W signal.

(A) Maximizing the Color Saturation

In the set color solid, the color saturation is modified so that it may be pasted on the surface of the color solid. If importance is placed on the contrast in the bright lighting condition, the color reproducibility is not so much requested. Hence, what is to be watched is just a hue. Though an input color signal may be placed on any location inside the color solid, the color located inside the color solid is moved to the surface of the color solid. This is effective in that the hue may be more easily watched. The concrete signal processing is executed to convert the RGB signal into a luminance signal, a hue signal and a saturation signal so that the saturation signal is modified into a maximum signal. Herein, the luminance and the hue may be kept at the same value. Then, the modified luminance, hue and saturation signals are re-converted into the RGB signal.

(B) Analysis of Input Data

To expand the input signal described in HTML language in the bitmap format and display an image represented by the input signal, it is possible to determine the color type of the data like characters to be represented on the basis of the codes of the HTML language. Further, it is also possible to determine whether or not a photo or a picture is contained in the input signal on the basis of the file format of JPEG, BMP or the like. That is, the characteristic of the input signal is allowed to be determined without having to expand the input signal in the bitmap format. Moreover, by rewriting the color specifying codes contained in the input signal, it is possible to modify the color of the bitmap expansion of the input signal. Herein, the rewrite of the color specifying code of the HTML is allowed to be properly modified in light of the relation between the RGB signal and the luminance, hue and color saturation. In particular, if the color specifying code designates the combination of the RGB primary colors, it is possible to determine that the input signal does not require the color reproducibility that is required if the code designates the natural image. These operations result in being able to pick up the characteristic data corresponding with the statistical measurement of the image to be displayed.

(C) Monochrome Display

If importance is put on the visibility in a bright lighting condition and the contrast is more important than the colors, the monochrome display is made possible without reproducing the colors. This is executed to convert the inputted RGB signal into the monochrome signal with no color.

(D) User Setting Mode

By preparing any means for prompting a user to enter his or her taste, it is possible to modify the colors. For example, it is possible to slightly shift the red hue.

(7) W Generating Circuit 103

Each signal of the RGBW is let to take a value of 0 to 1. Each of the RGB is visually different. In the following description, however, they are equivalent to one another. That is, if one of the RGB is replaced with another, no problem takes place in the expression. In addition, the nonlinear characteristic like the gamma characteristic is not treated in the description.

As the condition of W, if all of the RGB are zero, W=0, while if all of the RGB are 1, W=1. For this purpose, lots of methods for calculating W are prepared. The addition of W is changed depending upon the method. The embodiment of the present invention is characterized in that a plurality of operating methods are prepared and means for selecting the operating method is provided. The method for calculating the W signal will be described below.

$$W=\mathrm{MIN}(R,G,B) \tag{A}$$

The W derived as described above corresponds to a magnitude of a common component of the RGB. If an image is displayed in a sole one of the RGB or the CMY created by two of the RGB, the remaining color signals take a value of 0. Hence, W is equal to zero. The RGBCMY are the colors known as the three primary colors to be used for addition or subtraction. If those colors are displayed, W=0 is met. It means that the vividness of the image is not impaired but the addition of the W is not effective in improving the luminance. The color having the common component to the RGB and located inside the color solid additionally includes the W, so that the luminance may be improved. The effect of improving the luminance through the effect of the W sub-pixel as described above results in making the central portion of the color solid raised. Since the effect of the improving the luminance of the primary color signal cannot be obtained through the luminance of the white signal is made higher, the difference of the brightness is often made noticeable.

$$W=\mathrm{MAX}(R,G,B) \tag{B}$$

In the display of a sole one of the RGB, the white component is added to the color for the purpose of improving the luminance of the color.

$$W=(M(\mathrm{MAX}(R,G<B)-\mathrm{MIN}(R,G,B))+\mathrm{MIN}(R,G,B)) \tag{C}$$

This is an expression derived by combining the foregoing expressions (A) and (B) with each other with a new variable of M=0 to 1. In this expression, if M=0, W=MIN(R, G, B), while if M=1, W=MAX(R, G, B).

$$W=(1/3)(R+G+B) \quad \text{(D)}$$

The addition of the W component to the RGB primary colors is divided by three. Hence, the addition is multiplied by ⅓.

Additionally, $$W=(RGB) \quad \text{(E)}$$

$$W=(1/3)(RG+GB+BR) \quad \text{(F)}$$

Figure 5:
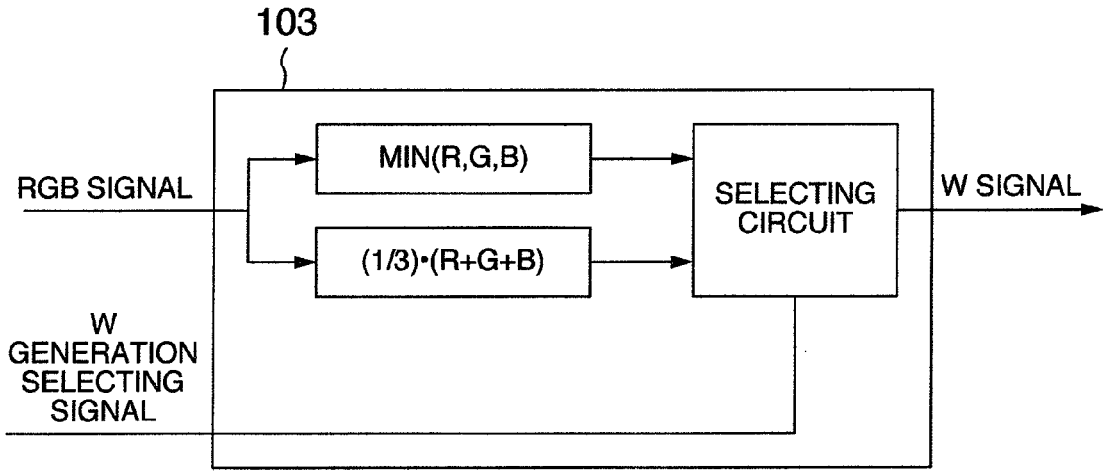
FIG. 5 is a diagram showing a W generating circuit included in the embodiment of the present invention.

According to the embodiment of the invention, one or more methods for calculating the W component are prepared. If two or more methods are prepared as shown in FIG. 5, there is provided a means for selecting the calculating method on a selection signal to be inputted from the W generation selecting circuit 104. This means allows the image quality on the display to be modified.

(8) W Generation Selecting Circuit 104

The method for generating the W signal may be used by properly switching those methods from one to another on the display screen. As a switching trigger, it is possible to use the analyzed result of the input data to be represented on the screen.

For example, the pixels on the screen are classified into:

1) pixels on which text and graphics are represented, 2) pixels in which color reproducibility is not so important but coloring is indispensable, 3) pixels in which color reproducibility is required.

wherein as to the pixels (1), if the signal processing processor executes the display in the HTML language, the location and the display content of the pixel are determined on the codes described in HTML language without expanding the signal in the bitmap form. Further, as to the photo data or the like, by checking an extension of the data, it is possible to determine the BMP (Bitmap Data) or the JPG (JPEG Compressed Data). Hence, without having to expand the photo data on a memory, the pixel location and the display content may be determined. Based on these determinations, the signal processing is switched as follows. As to the pixels on which text and graphics are represented, the contrast is highlighted, while as to the pixels on which a photo or the like is represented, the color reproducibility is highlighted.

Figure 6:
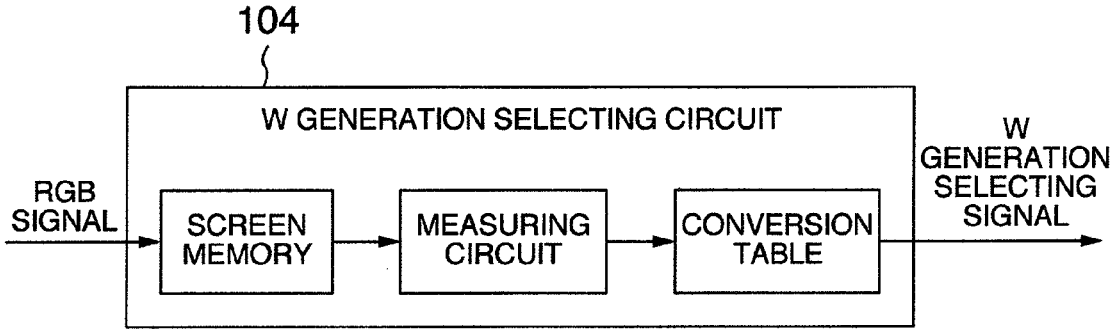
FIG. 6 is a block diagram showing a W generation selecting circuit included in the embodiment of the present invention.

Further, the statistical processing may be also carried out with respect to the image data having been expanded in the bitmap format. As shown in FIG. 6, the input RGB signal is temporarily stored in a screen memory. Then, the signal distribution on the screen is measured. By relating the pixel location with the display content, the signal processing may be switched in a manner that at the pixels where text and graphics are represented, the contrast is highlighted and at the pixels where a photo or the like is represented, the color reproducibility is highlighted. The statistical values include a color distribution (that is, an area ratio), an edge distribution, a frequency component, and so forth. The relation of the measured result with the output selecting signal is carried out by using the prepared conversion table, for example. The circuit arrangement described above may be transformed. For example, the screen memory may be removed or instead of the conversion table a function operating circuit may be used. The embodiment of the present invention is characterized in that as described above a means is prepared for generating a selecting signal for switching the signal processing method in the case of providing the W sub-pixel for a unit pixel on the screen, for the purpose of improving the image quality on the screen.

(9) K Correcting Circuit 105

The signals to be inputted thereto are a W signal and a coefficient K to be used for the using ratio of W. The circuit operates to correct the W signal. K is served as a means for adjusting the calculated using ratio of W and for selecting the color space. This circuit is effective in greatly changing the image quality on the display screen according to the modified K.

The present invention does not use the expression of W=MIN(R, G, B) as it is but uses the expression of W=MIN (R, G, B) derived by multiplying the former expression by the coefficient K. The use of this expression makes it possible to actively control the image quality on the display screen. If K=0, only the RGB pixels are active on the display screen, while if K=1, W becomes maximum if the RGB are all maximum. When the RGB primary colors are displayed on the screen, the luminance is improved through the color saturation becomes slightly lower.

Figure 7:
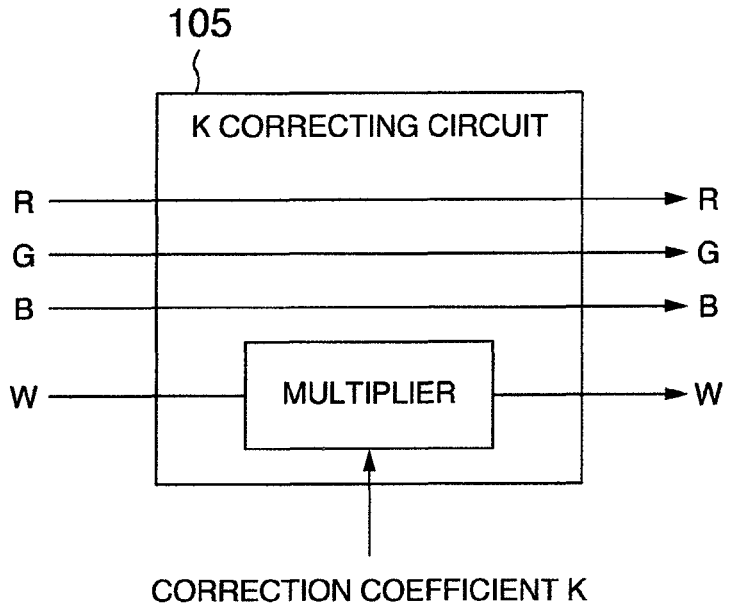
FIG. 7 is a diagram showing a K correcting circuit included in the embodiment of the present invention.
Figure 8A:
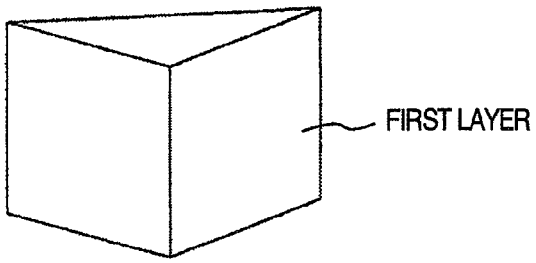
FIGS. 8A to 8D are views showing the effect caused by the transformation of the RGB color solid according to the embodiment of the present invention.
Figure 8C:
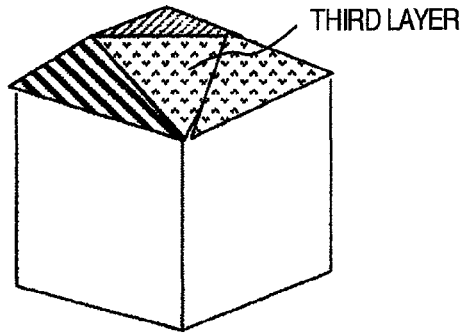
Figure 8B:
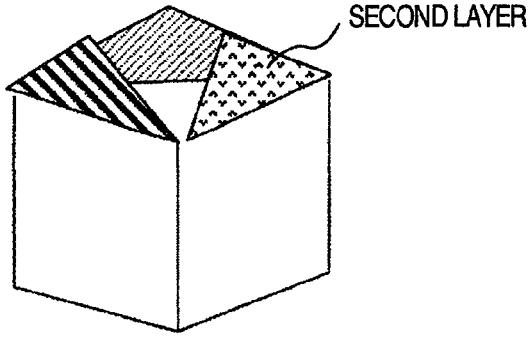
Figure 8D:
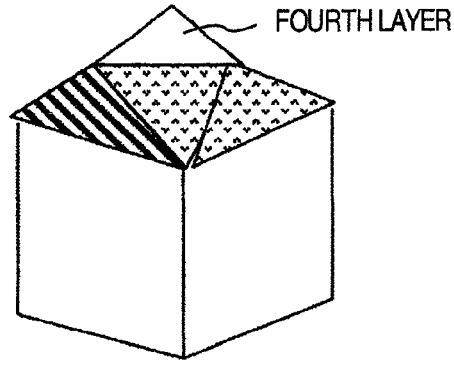

The embodiment of the present invention is characterized in that as shown in FIG. 7, WK derived by multiplying the W signal by the coefficient K is used as a new W signal. Further, not only the multiplication of K but also a function, the conversion table, and so forth may be used for this operation.

(10) Effect of Transformation of RGB Color Solid

FIGS. 8A to 8D show the color solids to be prepared for the purpose of describing the effect on the image quality on the display screen offered by the present invention. The color solid on a chromaticity diagram depicted on the additive color mixture of the RGB three primary colors may be decomposed into the following four layers. In addition, to make the description simple, it is assumed that the contribution of the luminance is the same in each of the RGB.

The first layer is a stage at which a sole one of the RGB three primary colors composes the color solid. In the first layer, a triangular prism in which the luminance is changed as keeping the chromaticity of the primary color is formed on the surface of the color solid. In general, the color gamut designates a horizontal section of this triangular prism.

The second layer is a stage at which two of the RGB three primary colors are mixed. The mixture of two of the RGB results in creating the YMC located on the line connecting two primary colors with each other. Three upward triangles (RGY), (GBC) and (BRM) with the YMC as a vertex are created on the surface of the color solid in a manner that the surfaces of the triangular prism may be extended upward. In this stage, the RGB three primary colors are not mixed with one another, so that the color saturation is not made lower.

The third layer is a stage at which each two colors of the triangular YMC are mixed. Each two colors of the YMC and one color of the RGB primary colors are mixed so that three downward triangles (YCG), (CMB) and (MYR) are created on the surface of the color solid. The YMCs of the second and the third layers point to the same point. In this stage of the mixture, the RGB three primary colors are mixed, so that the color saturation is made lower.

The fourth layer is a stage at which each two colors of the YMC located at the vertex of the third layer are mixed. In this layer, a triangular pyramid is created with a triangle created by the YMC as its bottom and the white as its vertex.

The foregoing description has been expanded on the principles. The color solid created by plotting the actual measured values of the display apparatus is often greatly warped. To make the description easier to understand, hence, the model diagram is used for representing the rough form of the color solid.

For example, if the foregoing W calculating method (A) is used, letting W be the common component of the RGB (that is, the minimum value of the RGB), the W sub-pixel is used for representing an image so that the W may be expanded. This expansion corresponds to the vertical extension of the fourth layer of the color solid. This is because the first to the second layers correspond to the color solid area that does not include the common component of the RGB, that is, those layers do not have the W so that no change takes place in the display colors. The third layer is transformed so that both of the layers are connected with each other. In the color solid with the expanded W, no change takes place in the RGB primary colors and the luminance of the color closer to an achromatic color is increased. The change of the form of the color solid caused by the increased W depends upon the method for calculating the W signal. The change of the form of the color solid brings about the change of the image quality on the display screen. The method for generating the W signal and the condition corresponding with the method may be determined as a designing matter.

As described above, the form of the color solid is vertically stretched according to the mixing quantity of the white component. The horizontally cut section of the color solid is stretched in inverse proportional to the vertical stretch. That is, the stretch of the luminance is conflicting with that of the color saturation. However, this conflicting relation is rational if the brightness of the lighting condition around the display apparatus is considered. When a higher luminance is required in a bright lighting condition, the request for color reproducibility is made lower. On the other hand, when the luminance is not so required in a gloomy lighting condition, the color reproducibility is made more important. If the display apparatus is set to have this kind of request for image quality, the change of the form of the color solid meets the request.

(11) RGBW Signal Equalizing Circuit 106

To make the description simple, assuming that each of the RGB has the same luminance and the W is a luminance of the RGB three primary colors, the ratio of the maximum luminance of the RGBW is 1:1:1:3. For example, letting the RGB signal be 0.5 and the W signal be 1.0, the total of the display luminance of the RGBW on the display screen is 4.5 and the ratio of the display luminance of each of the RGBW is 1:1:1:6. If an observer watches this display screen, since the display luminance of the W is higher than that of the RGB, the observer visually senses the grainy spots as the W sub-pixels. Hence, the embodiment of the present invention is characterized in that the brightness is made uniform in each of the RGBW by using the metamerism of the foregoing display apparatus for the purpose of dissolving the visually sensed grainy image on the display screen. For example, thus, setting the color signals of the RGBW as 1.35, 1.35, 1.35 and 0.45 respectively, it is possible to make the display luminance ratio of the RGBW 1:1:1:1 as keeping the total of the display luminance as 4.5 and the colors on the display screen. In this example, however, since it is necessary to keep each RGB signal as 1 or more, this setting is not practical. In another exemplary setting, setting the color signals of the RGBW as 1, 1, 1 and 0.5 respectively, it is possible to make the display luminance ratio of the RGBW 1:1:1:1.5 as keeping the total of the display luminance as 4.5 and the colors on the display screen. This setting makes it possible to suppress the difference as compared with the initial set ratio of 1:1:1:6 and make the display luminance ratio of the RGBW uniform, thereby being able to dissolve the visually sensed grainy image on the display screen.

Figure 9:
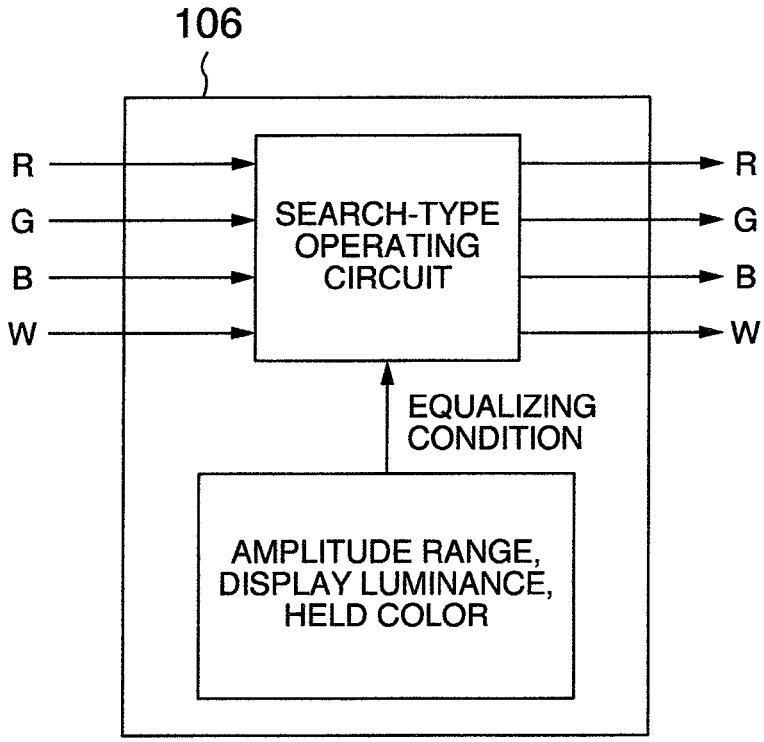
FIG. 9 is a block diagram showing an equalizing circuit of a RGBW signal used in the embodiment of the present invention.

To execute the procedure as described above in a computer, an arrangement shown in FIG. 9 is prepared in which a loop-type operation with an amplitude range of a color signal, a held display luminance, a held color and so forth as the determining conditions is executed in a search-type manner. Then, by making the display luminance ratio of the RGBW more and more uniform in the range where the determining conditions are met, the proper result can be obtained. Instead, if it is possible to prepare an equation to be analytically solved, the use of this type of equation makes it possible to calculate the proper result without having to execute the loop-type operation.

The embodiment of the present invention is characterized in that the display luminances of the RGBW sub-pixels are made uniform by converting the combination of the RGBW signals as keeping the colors and the luminance of the RGBW signals through the use of the property of the metamerism. This makes it possible to dissolve the visually sensed grainy image on the display screen and thereby improve the image quality.

In the foregoing description, the display luminance ratio of the RGBW sub-pixels is made simple. In the actual display apparatus, the ratio may be set on the basis of the measured values. Further, in the display apparatus provided with the sub-pixels of the other wavelength distributions rather than those of the RGB sub-pixels, the same effect can be obtained by executing the same procedure. If the pixels are flashed for a certain length of time, the same idea may hold true to this case. That is, by making the display luminance ratio uniform on the coordinate axis of time and area, it is possible to improve the image quality.

(12) Backlight Modulating Circuit 107

In a case that the liquid crystal panel is composed of the RGBW sub-pixels and the backlight unit is a light source of each color of the RGBW, the degree of freedom in the combination of the colors is further enhanced. The W light source basically provides the same wavelength characteristic as the wavelength obtained by making the RGB light sources luminous at the same time. On the other hand, if the RGB light sources are individually adjusted, the wavelength characteristic may be greatly changed. The wavelength distributions of these light sources do not necessarily coincide with the wavelength distribution of the color filter provided in the liquid crystal panel. Herein, however, to make the description simple, both of them coincide with each other. If they mismatch to each other, the color variation caused by the mismatch may be suppressed on the display screen by correcting the signal for driving the pixels composing the liquid crystal panel.

The liquid crystal display is composed of the sub-pixels, arranged by combining the liquid crystal elements for controlling a light transmittance and the color filters having a wavelength distribution characteristic, and a backlight unit that applies a ray of light to the liquid crystal panel composed of many sub-pixels ranged on the plane. Herein, the quantity of light supplied from each sub-pixel is represented by a product of a quantity of backlight and a light transmittance of liquid crystal, excepting the nonlinear elements such as the gamma characteristic (in order to make the description simple). Though the larger quantity of backlight than a required quantity of light for an image display is in reverse proportion to the liquid crystal transmittance, if the quantity of backlight is fixed, the liquid crystal transmittance is uniquely defined. Hence, it is possible to set the minimum quantity of light required for causing an image display by making the quantity of backlight variable and set such a liquid crystal transmittance as keeping the reverse proportional relation. The display output at this time is not changed. Concretely, by measuring the maximum value of the input signal on the screen, it is possible to set the quantity of backlight so that the maximum value may appear on the screen. Since the quantity of backlight is lower than the maximum light quantity, the power consumption may be reduced.

In the display apparatus provided with the RGBW panel, as described above, the basic principle of the display operation is represented by a product of a backlight quantity and a light transmittance of liquid crystal. Then, by variably setting the backlight quantity, it is possible to reduce the power consumption. However, the RGBW panel to be driven by the present invention does not use the input RGB signal as it is but uses the RGB signal converted according to the using ratio of the W sub-pixel. To set the backlight quantity, therefore, it is impossible to use the maximum value of the input RGB signal on the display screen. In the embodiment of the present invention, when the backlight quantity is fixed (to the maximum value), the operation is executed to measure the RGBW signal calculated on the using ration of the W sub-pixel, detect the maximum value on the display screen, and variably set the backlight quantity so that the maximum value may be displayed on the screen according to the detected result. Hence, if the input RGB signal is constant, the backlight quantity is made variable depending upon the brightness of the lighting condition around the display apparatus. Further, if the brightness of the environment is constant, the backlight quantity is made variable depending upon the input RGB signal.

Figure 10:
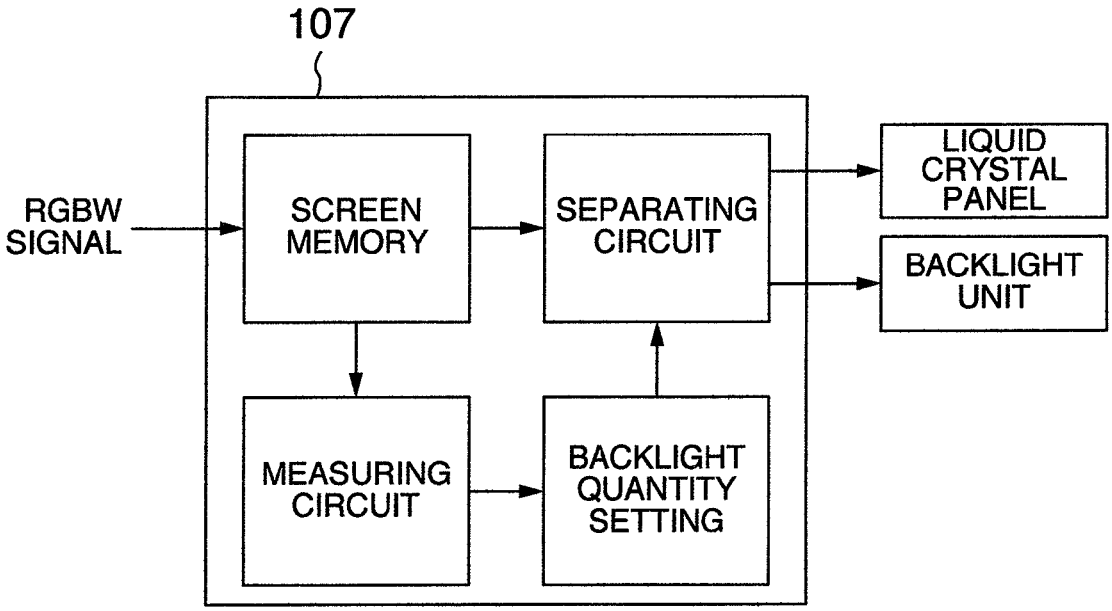
FIG. 10 is a block diagram showing a backlight modulating circuit included in the embodiment of the present invention.

As shown in FIG. 10, the RGBW signal is inputted into the backlight modulating circuit 107. In the circuit, the signal is temporarily stored in a screen memory. This storage is intended for delaying the signal so that the screen on which the signal is measured may coincide with the screen on which the signal processing is executed on the measured result. In a case that it is determined that no influence is applied to the screen if a mismatch of one screen image appears, the screen memory may be removed. Then, the signal characteristic is measured on the screen and the minimum backlight quantity required for the display is calculated. Based on the calculated result, the input RGBW signal is separated into the driving signal of the liquid crystal panel and the driving signal of the backlight unit. These driving signals are supplied to the corresponding destinations. The display screen watched by an observer corresponds to a combination of these signals.

Further, the embodiment of the present invention uses the phenomenon brought about in the display apparatus as the metamerism of the visual sense. Concretely, since the wavelength distribution of the W is overlapped with that of the RGB, a degree of freedom in the combination of the RGBW required for outputting the same color takes place. This degree of freedom is used by the invention. In each pixel, the RGBW signal required for displaying the same color is modified so that the maximum value becomes minimal by using the degree of freedom. Then, the maximum value on the screen is detected and the backlight quantity is set so that the maximum value may appear on the screen.

In the foregoing description, it is assumed that the backlight quantity is made uniform on the screen. Instead, by properly modulating plural light-emitting units composing the backlight unit, it is possible to emit light so that the light is distributed on the screen. That is, it is possible to provide plural areas on the screen and control a light quantity on each area. Further, the light may be emitted so that the wavelength characteristic is distributed. Concretely, if the backlight unit is composed of LEDs, the independent control of the modulation of the light quantity depending on a certain position on the screen or the modulation of the light quantity depending on the wavelength of the RGB or the like may be served as the backlight unit. As described above, by setting the backlight quantity required for displaying an image, it is possible to reduce the power consumption as compared with the constantly lit backlight unit.

(13) Another Exemplary Arrangement

Figure 11:
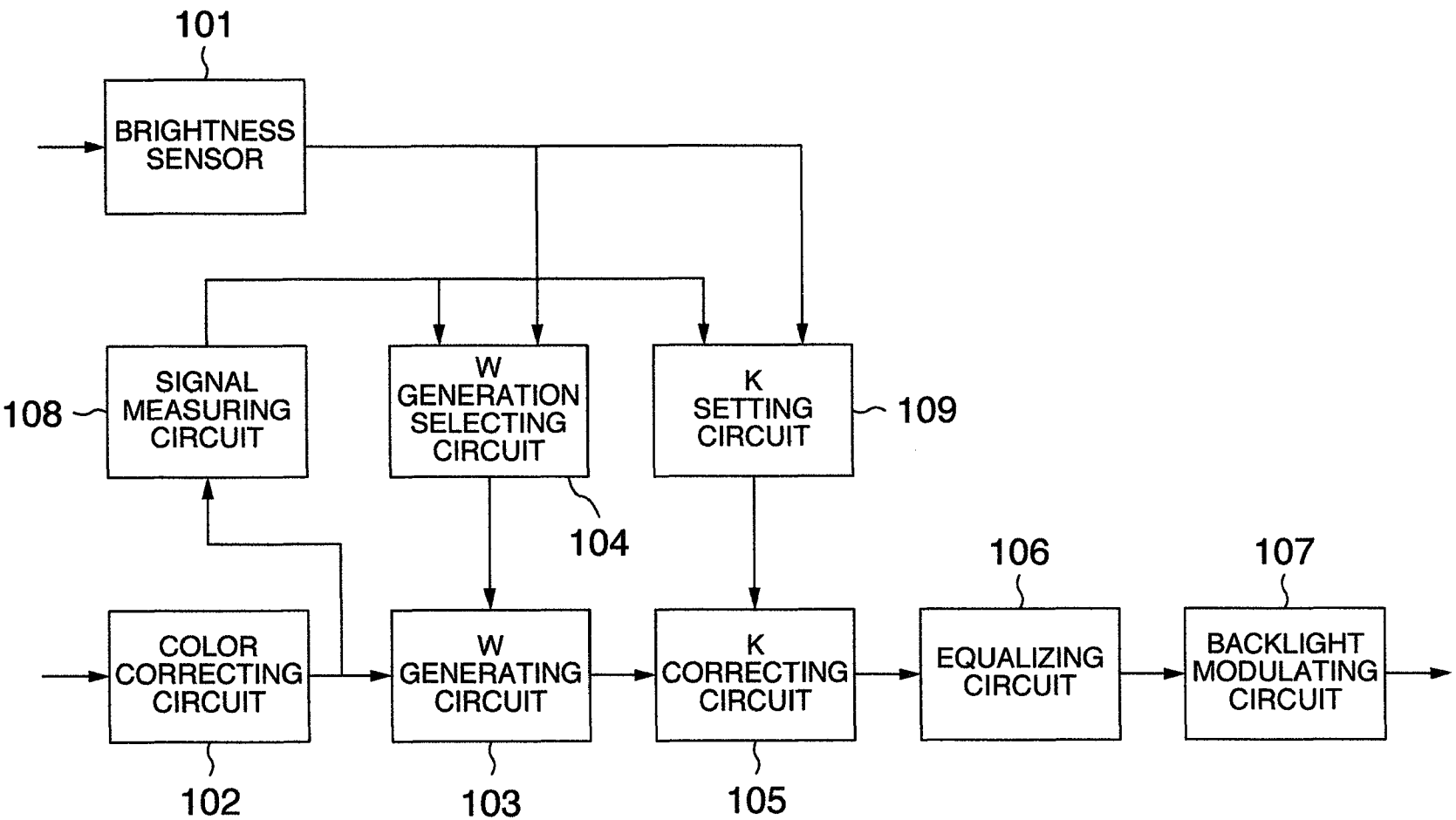
FIG. 11 is a block diagram showing an exemplary arrangement of a signal processing circuit included in another embodiment of the present invention.

In the foregoing description, the W generating circuit 103 is controlled in response to a signal sent from the W generation selecting circuit 104 and the K correcting circuit 105 is controlled in response to a signal sent from the brightness sensor 101. The circuits to be controlled and the control circuits may be properly overlapped with each other. This overlapped arrangement results in increasing the degree of freedom in the control. To describe this, FIG. 11 shows another arrangement having new components of a signal measuring circuit 108 and a K setting circuit 109.

The signal measuring circuit 108 has a function of measuring a signal characteristic of an input RGB signal and conveying the measured result to the W generation selecting circuit 104 and the K setting circuit 109. At a time, the output signal of the brightness sensor 101 is also conveyed to the W generation selecting circuit 104 and the K setting circuit 109. In this arrangement, the W generation selecting circuit 104 and the K setting circuit 109 are served to generate a control signal for controlling the W generating circuit 103 and the K correcting circuit 105. This control signal includes more information and thus is highly accurate.

As a signal characteristic to be measured by the signal measuring circuit 108, it is possible to use a signal distribution on a certain area (that is, an area a signal occupies), a presence or absence of an edge, frequency components, a color distribution, and so forth.

Figure 12:
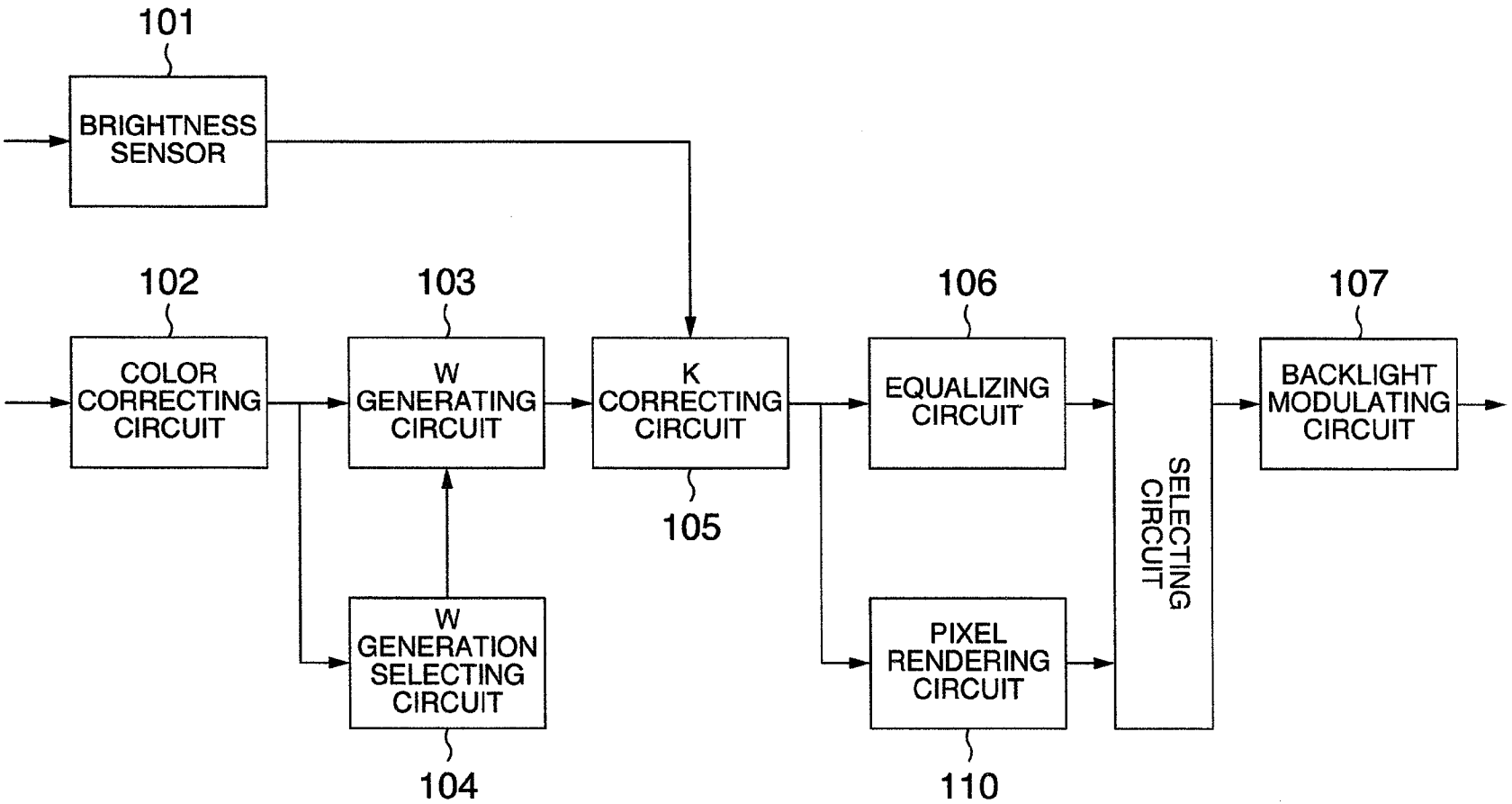
FIG. 12 is a block diagram showing an exemplary arrangement of a signal processing circuit included in another embodiment of the present invention.

FIG. 12 shows another arrangement of the display apparatus according to the embodiment of the present invention, in which a pixel rendering circuit 110 is located. The pixel rendering is a method in which the two-dimensional location of the adjacent pixels is considered as one of the signal processing conditions when processing each signal of the RGBW sub-pixels. For example, this method is executed to calculate the locations of the RGBW signals required for displaying a smooth contour over an area where text and graphics are depicted. The present invention is characterized in that the pixel rendering is carried out with respect to the RGBW signals after the W signal is calculated. Then, the present invention provides a capability of properly selecting an output of the equalizing circuit 106 or an output of the pixel rendering circuit 110 so that a uniform area and an edge area may be displayed on the display screen with high visibility according to the selected output. Though not shown herein, the selecting method may be executed by a determining circuit that uses the measured result of the signal measuring circuit 108 for the determination.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display apparatus comprising a panel including pixels, each of which has RGBW (Red, Green, Blue and White) wavelength distribution characteristics, ranged two-dimensionally and a backlight, comprising:

a brightness sensor for detecting brightness of an external environment;

a W generation circuit for outputting an RGWB signal using an inputted RGB signal;

a correcting circuit for outputting an adjusted RGBW signal in which a W signal is adjusted in the RGBW signal in accordance with an output signal of said brightness sensor;

a backlight modulating circuit for outputting a signal for driving said panel and for driving said backlight in accordance with said adjusted RGBW signal;

wherein a maximum value of luminance of said adjusted RGBW signal is detected when the quantity of light of said backlight is fixed as a maximum, and wherein quantity of light of said backlight is decreased using the maximum value of quantity of light of said backlight as a reference, in accordance with a maximum value of luminance of said adjusted RGBW signal, and transmittance of said panel is increased using transmittance of said panel when quantity of light of said backlight is fixed to a maximum as a reference.

2. The display apparatus as claimed in claim 1, wherein the correcting circuit calculating the adjusted the RGBW signal includes plural kinds of calculating means for calculating a W signal from the RGB input signal and the W using ratio and means for selecting one of the W signal calculating means.

3. A display apparatus comprising a panel including pixels, each of which has RGBW (Red, Green, Blue and White) wavelength distribution characteristics, ranged two-dimensionally, and a backlight comprising:

means for setting a display luminance of the display apparatus;

a brightness sensor for detecting brightness of an external environment;

a W generation circuit for outputting an RGWB signal using an inputted RGB signal;

a correcting circuit for outputting an adjusted RGBW signal in which a W signal is adjusted in the RGBW signal in accordance with an output signal of said brightness sensor;

a backlight modulating circuit for outputting a signal for driving said panel and for driving said backlight in accordance with said adjusted RGBW signal;

wherein a maximum value of luminance of said adjusted RGBW signal is detected when the quantity of light of said backlight is fixed as a maximum, and wherein quantity of light of said backlight is decreased using the maximum value of quantity of light of said backlight as a reference, in accordance with a maximum value of luminance of said adjusted RGBW signal, and transmittance of said panel is increased using transmittance of said panel when quantity of light of said backlight is fixed to a maximum as a reference.

4. The display apparatus as claimed in claim 1, further comprising:

plural kinds of W signal calculating means; and selecting means for selecting any one of the plural kinds of W signal calculating means.

5. The display apparatus as claimed in claim 1, wherein the correcting circuit sets the using ratio of the W sub-pixel by specifying a luminance improving effect based on a brightness sensor output signal through the use of conflicting relation between the luminance improving effect and a color reproducing characteristic both depending upon the using ratio of the W sub-pixel.

6. The display apparatus as claimed in claim 1, wherein the correcting circuit performs a signal conversion for modifying light quantities of the RGB sub-pixels and the W sub-pixel as keeping the luminance and the color of the RGBW signal to be inputted.

7. The display apparatus as claimed in claim 1, further comprising:

a liquid crystal panel provided with three or more (RGBW) color filters, for controlling a light transmittance; and means for optionally setting a combining ratio of the light transmittance of the liquid crystal panel to light quantities of plural kinds of light sources so that input color signals may be displayed on the liquid crystal panel; and wherein each of the light sources has at least one wavelength distribution.

8. The display apparatus as claimed in claim 1, wherein a combining ratio setting means sets the combining ratio of the transmittance of the panel to the light quantities of the light sources so that the driving power for the light sources may be made minimal.

9. The display apparatus as claimed in claim 1, further comprising:

a liquid crystal panel provided with three or more (RGBW) color filters, for controlling a light transmittance;

means for setting a light transmittance of a liquid crystal panel and light quantities of plural kinds of light sources; and means for modifying the light transmittance of the liquid crystal panel and the light quantities of plural kinds of light sources, set by the setting means, as keeping the display of the color colors; and wherein the modifying means modifies the light transmittance and the light quantities so that a driving power for the light sources may be made minimal and the light source has at least one wavelength distribution.

10. A display apparatus comprising a panel including pixels, each of which has RGBW (Red, Green, Blue and White) wavelength distribution characteristics, ranged two-dimensionally and a backlight, comprising:

a brightness sensor for detecting brightness of an external environment;

a W generation circuit for outputting an RGWB signal using an inputted RGB signal;

a correcting circuit for outputting an adjusted RGBW signal in which a W signal is adjusted in the RGBW signal in accordance with an output signal of said brightness sensor;

a backlight modulating circuit for outputting a signal for driving said panel and for driving said backlight in accordance with said adjusted RGBW signal;

a maximum value of luminance of said adjusted RGBW signal is detected when the quantity of light of said backlight is fixed as a maximum, and wherein quantity of light of said backlight is decreased using the maximum value of quantity of light of said backlight as a reference, such that a product of quantity of light of said backlight and the maximum value of a signal for setting transmittance of said panel is constant, and wherein transmittance of said panel is increased using transmittance of said panel when the quantity of light of said backlight is fixed to a maximum as a reference.

* * * * *